US006226964B1

(12) United States Patent
Vettorato

(10) Patent No.: US 6,226,964 B1
(45) Date of Patent: May 8, 2001

(54) METHOD FOR FORMING BAGS IN PLASTIC MATERIAL AND THE BAG THUS PRODUCED

(75) Inventor: Natale Vettorato, Minerbio (IT)

(73) Assignee: B.L. Macchine Automatische S.p.A., Minerbio (IT)

( * ) Notice: Subject to any disclaimer, the term of this patent is extended or adjusted under 35 U.S.C. 154(b) by 0 days.

(21) Appl. No.: 09/269,862

(22) PCT Filed: Oct. 20, 1997

(86) PCT No.: PCT/IB97/01291

§ 371 Date: May 19, 1999

§ 102(e) Date: May 19, 1999

(87) PCT Pub. No.: WO98/18674

PCT Pub. Date: May 7, 1998

(30) Foreign Application Priority Data

Oct. 31, 1996 (IT) ..... BO96A0550

(51) Int. Cl.[7] ..... B65B 7/08

(52) U.S. Cl. ..... 53/482; 53/374.7; 53/372.7; 383/94

(58) Field of Search ..... 53/482, 374.7, 53/375.2, 372.4, 372.7, 456, 460; 383/94, 121, 122

(56) References Cited

U.S. PATENT DOCUMENTS 2,152,323 * 3/1939 Moore .
2,196,666 * 4/1940 Moore .
2,229,864 * 1/1941 Moore .
2,319,956 * 5/1943 Snyder .
2,374,793 * 5/1945 Waters .
2,692,074 * 10/1954 Mueller et al. .
3,089,298 * 5/1963 Neuendorf et al. .
3,438,176 * 4/1969 Reil et al. .

FOREIGN PATENT DOCUMENTS 14 61 938 3/1969 (DE) .
2 643 340 8/1990 (FR) .
2 676 990 12/1992 (FR) .
930811 7/1963 (GB) .
1115636 5/1968 (GB) .
1141714 1/1969 (GB) .

* cited by examiner

*Primary Examiner*—Peter Vo
*Assistant Examiner*—John Paradiso
(74) *Attorney, Agent, or Firm*—Brown, Martin, Haller & McClain, LLP

(57) ABSTRACT

A method for making bags out of plastic material includes the cutting of individual portions from a roll of a tubular element and the simultaneous making of a bottom seam crosswise to the tubular element itself. Each portion is set up as to form a bag with a filling opening at the opposite end of the bottom seam. The extremities of the bottom of the bag are pressed down so as to form angular sections which are sealed by means of seams made crosswise to the bottom seam and folded back against the external surface of the bag. The filling opening is sealed by a crosswise top seam after the bag has been filled with the relevant products. Angular sections are then defined at the extremities opposite to the top of the bag. The angular sections are sealed by means of seams made crosswise to the top seam and folded back against th external surface of the bag.

11 Claims, 7 Drawing Sheets

METHOD FOR FORMING BAGS IN PLASTIC MATERIAL AND THE BAG THUS PRODUCED

BACKGROUND OF THE INVENTION

The present invention relates to a method for forming bags from plastic material.

It is known that various products such as granular products and the like are packed in plastic material bags which are hermetically sealed by means of heat sealing. These bags are employed for both product transportation and storage and generally bear on the outside the information for proper identification of their contents.

Presently, these bags are made starting from a tubular element of plastic material in a sheet, which is folded so as to form gussets along its opposite sides and flat wrapped in a roll. Individual portions, each bearing a crosswise seam which defines the bottom of the bag to be formed, are then cut from the roll.

FIGS. 1 to 3 illustrate a prior art bag of this type. As shown in FIG. 1 for greater clarity, the bottom seam 2 extends to the overlapping sheets 3 and 4 of the tubular element 1 across the entire width of the same. Along the side edges, however, the seam also extends to flaps 3*a* and 4*a* folded inwards so as to form a gusset within sheets 3 and 4. In such circumstances the sealing conditions between the central area of the tubular element 1 where only the two sheets 3 and 4 are to be sealed together, and the side sections where four overlapping sheets are to be joined, that is sheets 3 and 4 as well as their relevant flaps 3*a* and 4*a* folded inwards to form the gussets, are markedly different. Seams made under these sealing conditions are far from ideal for both the central and the side sections of the gusseted tubular element.

This is rather a makeshift solution as the seam joining the central and side sections is made under differential sealing conditions, so that resistance at the critical point joining these two sections and indicated by C in FIG. 1 is weaker.

So as to at least partially overcome this drawback, that is to improve resistance at the aforementioned critical point C, additional angular seams 5 are made, which are symmetrically arranged at the bottom and at the top of the bag.

These angular seams 5 are made in the section of the tubular element where the portion of the material defining the bag is subsequently cut and involve simultaneously the top of the preceding bag and the bottom of the subsequent one.

The angular seams 5 at the top of the bag cause a constriction of the opening 6 through which the bag is filled, as can be seen in FIG. 2 where 7 indicates the gripping elements which widen the opening 6. This constriction causes a proportional reduction in the amount of product which may be introduced through the opening 6 at a time, i.e., in the filling rate, and therefore in overall productivity. To eliminate this drawback, an attempt has been made to improve the filling rate by increasing the height from which the product was dropped into the bag, albeit this increased the risk of product spillage and so on.

The gusseted tubular element is then sealed by means of a second crosswise seam 8 which defines the top of the bag as shown in FIG. 3 where 9 indicates the finished bag thus obtained. The same considerations made as to the reduced resistance at critical point C owing to the sealing of the gusseted folded flaps also applies to seam 8 at the top of the bag.

It should also be pointed out that the bags are easily subject to blows, falls and other similar events during handling and that such circumstances are extremely testing on the resistance of the aforementioned critical point.

Another drawback inherent in traditional gusseted bags is associated with the need to print identification data on to their outer surfaces. In order to do this, the surface which has to bear the printed data must be pre-treated accordingly so as to ensure that the ink to be applied will not come off. This treatment however hampers the perfect sealing of the plastic material so that it should preferably be avoided, or at least limited, in the folded side areas which are precisely those of the critical point where seam resistance is weaker.

In other words, there is the risk that any information printed in these areas will not be permanent so that there is no choice but to print the information on the front or back of the bags.

Such a limitation however detracts from the visibility of the printed information especially when the bags are stacked in piles or stored on shelves. In such circumstances, in fact, the information should ideally be printed on the sides so as to be easily and clearly visible and legible.

The object of the present invention is an easy and economic method for producing bags from plastic material which are highly resistant in particular in correspondence to the closing seams at the top and bottom.

SUMMARY OF THE INVENTION

A further object of the present invention is a method for producing bags from plastic material at high speed so as to ensure a high productivity rate. An additional object of the present invention is a method for easily printing product identification data on the entire external surface of the bag.

BRIEF DESCRIPTION OF THE DRAWINGS

The present invention will be better understood from the following detailed description of an exemplary embodiment of the invention, taken in conjunction with the accompanying drawings, in which like reference numerals refer to like parts, and in which.

DETAILED DESCRIPTION OF THE DRAWINGS

Figure 13:
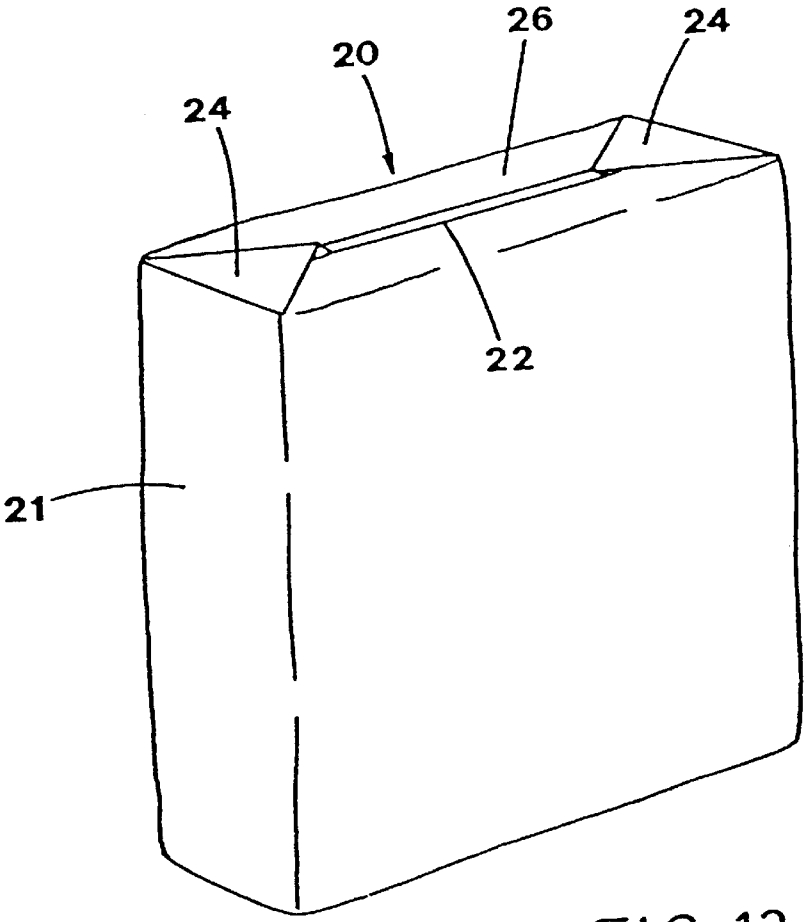
FIG. 13 is a perspective view of the bag thus formed.

FIGS. 4 to 12 illustrate a series of steps in a method of forming bags according to an exemplary embodiment of the invention, while FIG. 13 illustrates a bag as formed according to the method.

With reference to the accompanying drawings, 10 is a tubular element of plastic material in a sheet wrapped in a roll (FIG. 4), intended for forming the bags 20 as shown in FIG. 13.

Figure 1:
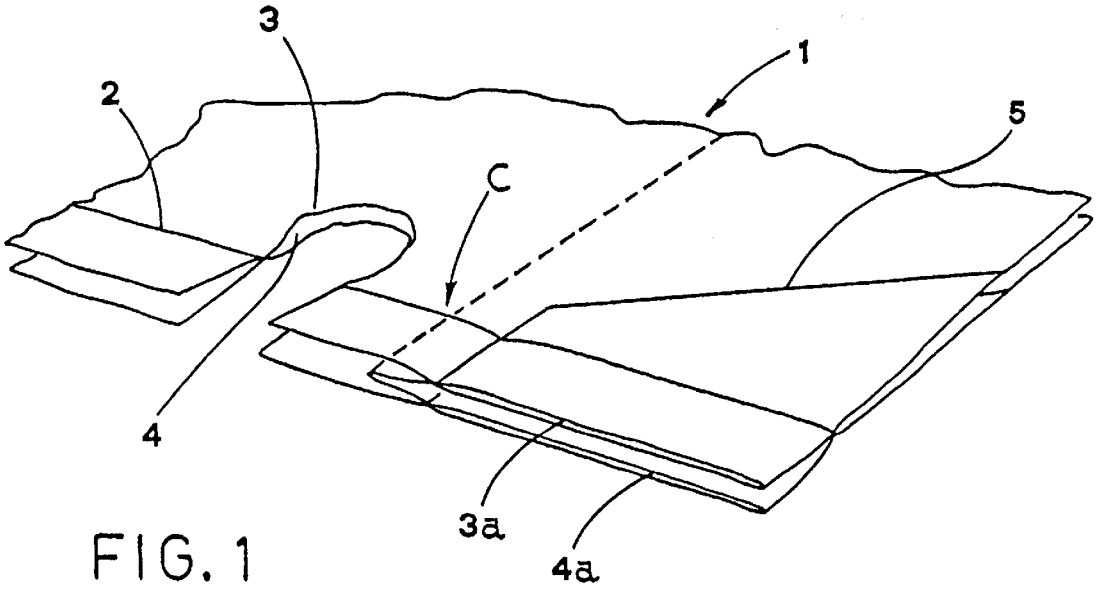
FIG. 1 PRIOR ART
FIG. 1 is a perspective view of a portion of a traditional bag in plastic material.
Figure 2:
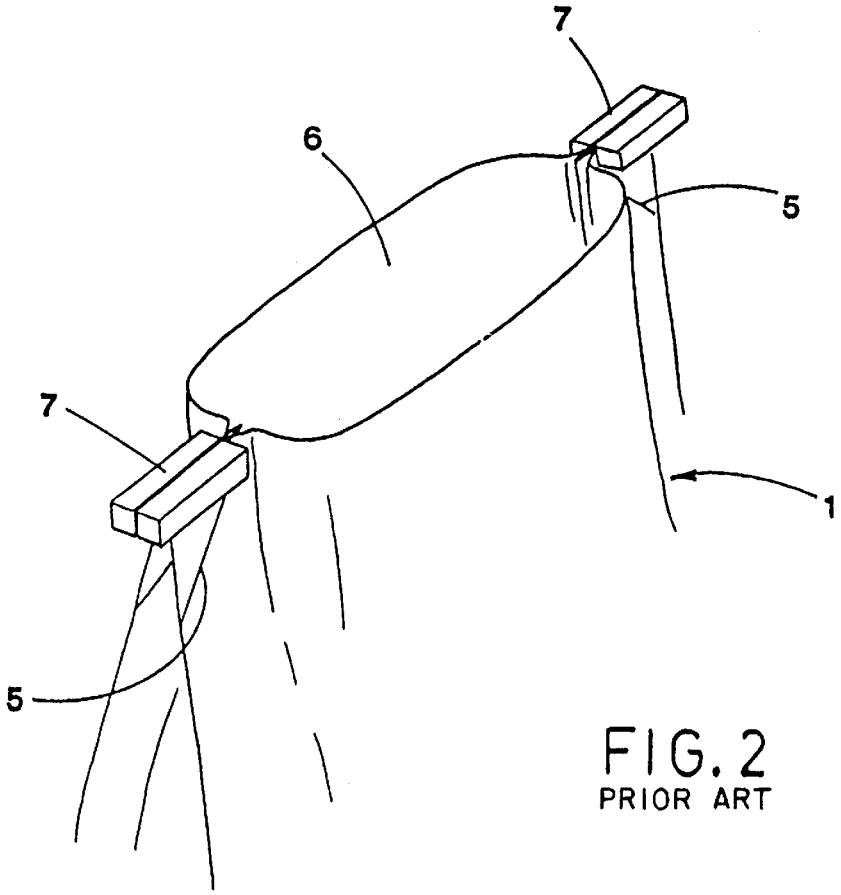
FIG. 2 PRIOR ART
FIG. 2 is a partial perspective view of said traditional bag during filling.
Figure 3:
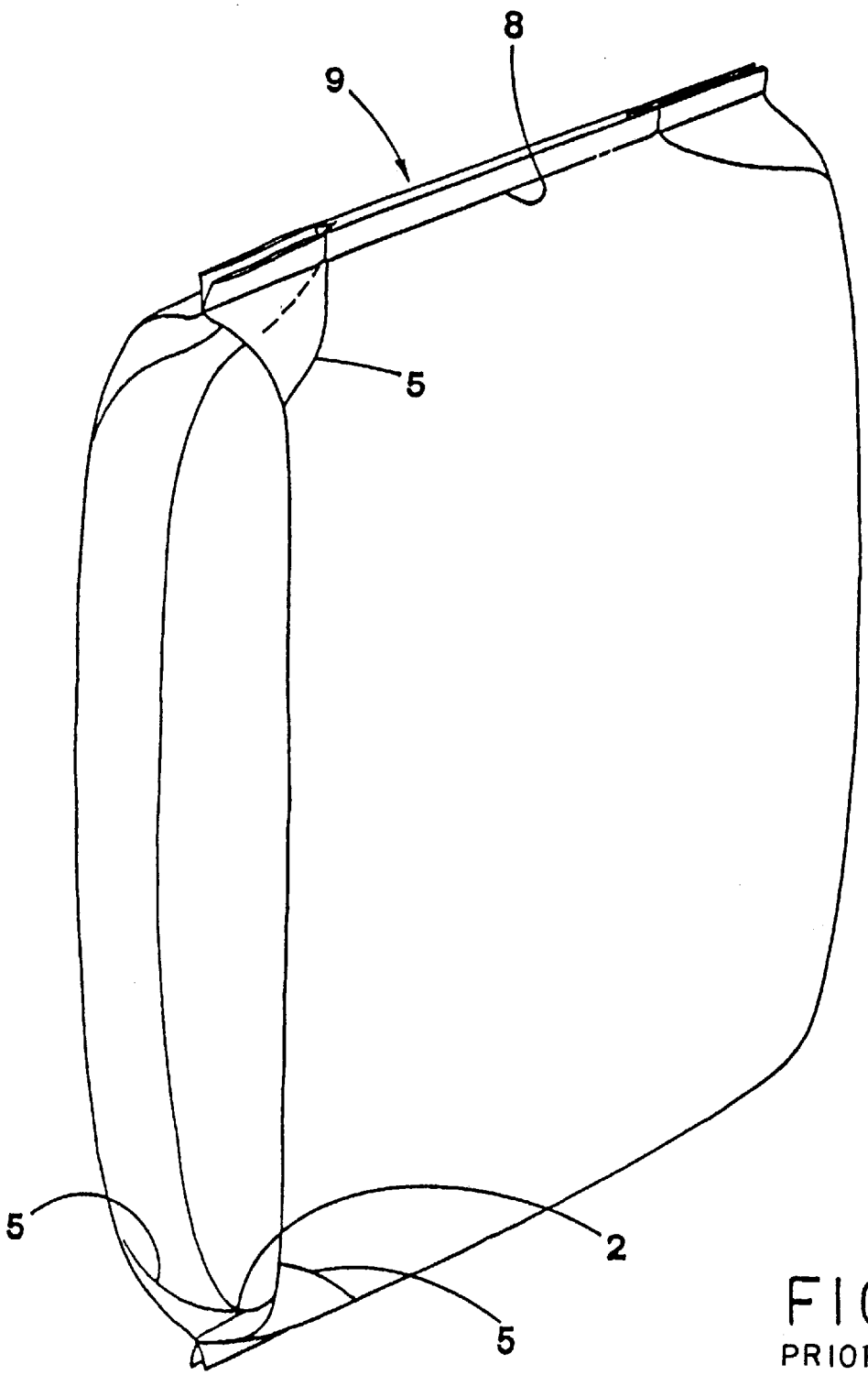
FIG. 3 PRIOR ART
FIG. 3 is a perspective view of said traditional bag in its final configuration.
Figure 4:
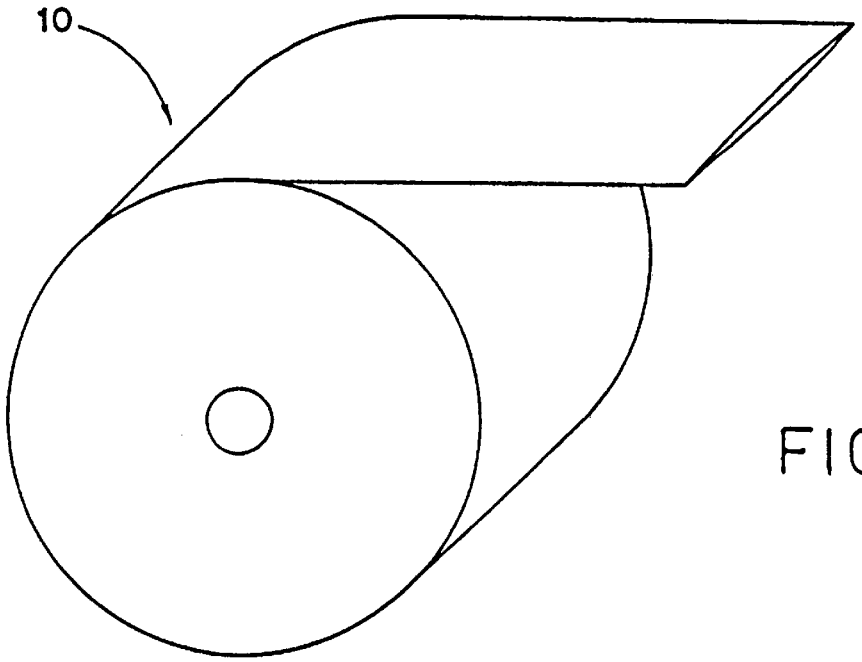
FIGS. 4, 5, 6, 7, 8, 9, 10, 11 and 12 are schematic perspective views of the various steps of a method according to an exemplary embodiment of the invention for forming bags in plastic material.
Figure 5:
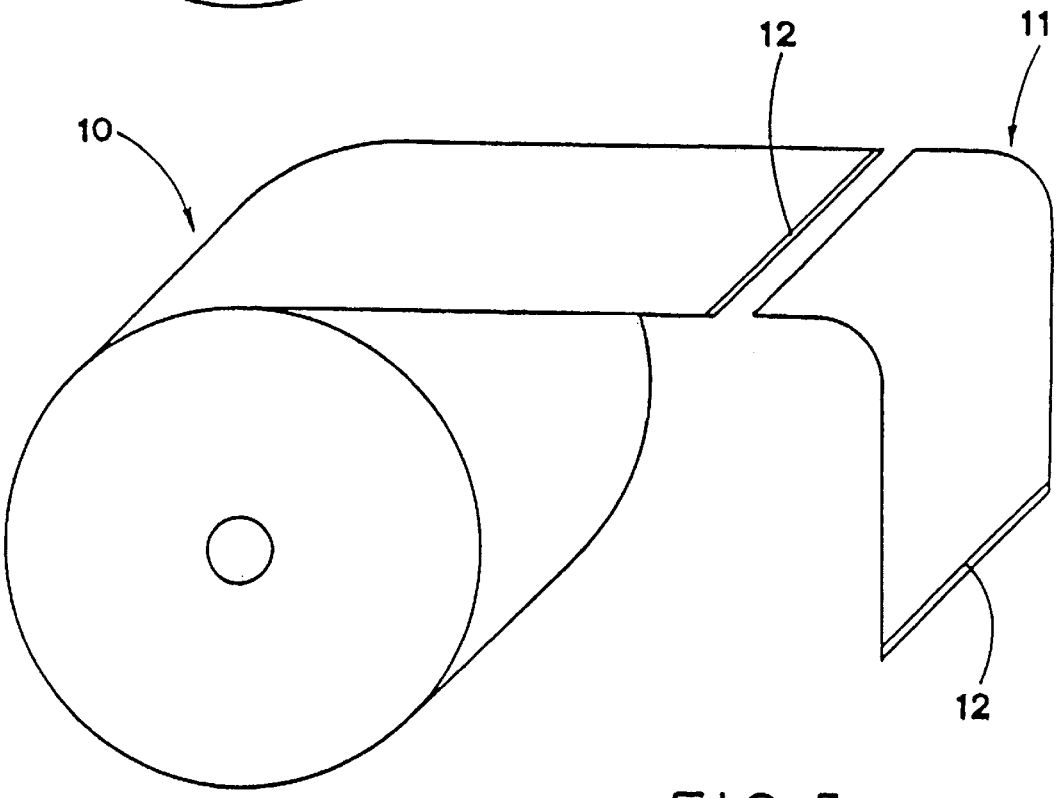

The method for forming said bags 20 comprises cutting individual portions 11 from said roll 10 and simultaneously making a crosswise seam 12 the purpose of which is to define the bottom of the bag. Seam 12 is made adjacent to the cutting or severance line on the roll 11 side, that is in correspondence to the bottom section of the subsequent portion to be cut (FIG. 5). Seam 12 extends across the entire width of the tubular element.

Figure 6:
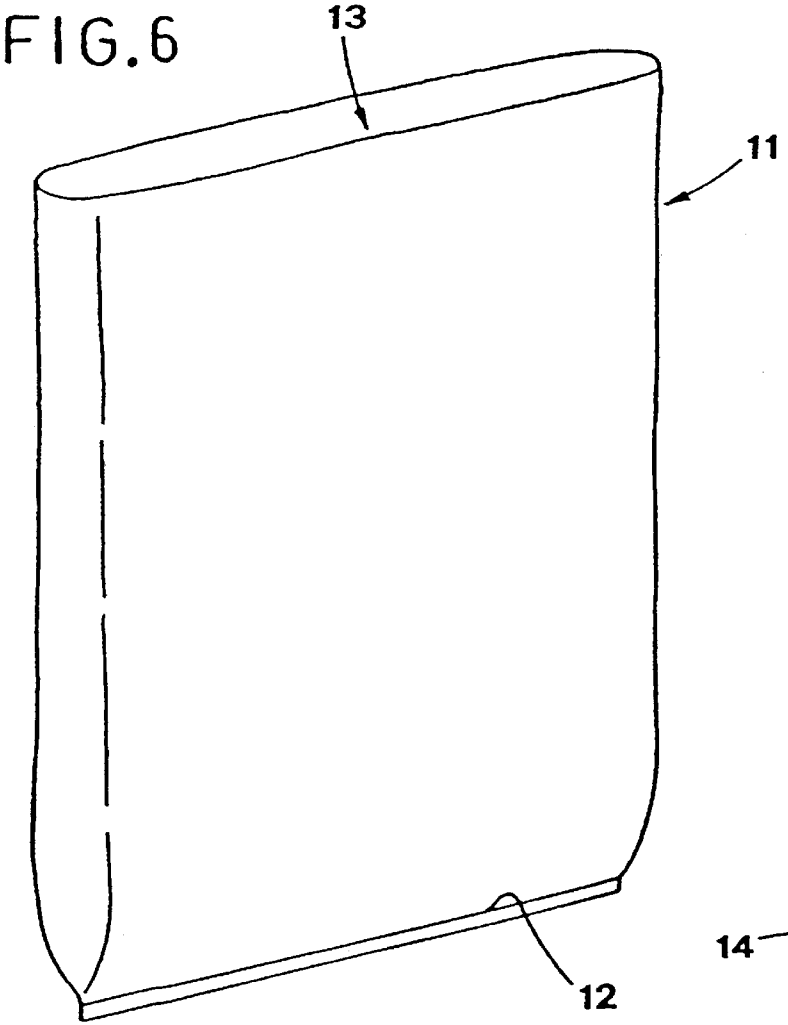

The individual tubular portion 11 cut from roll 10 is subsequently formed so as to obtain the desired bag configuration, with filling opening 13 at the top (FIG. 6).

Figure 7:
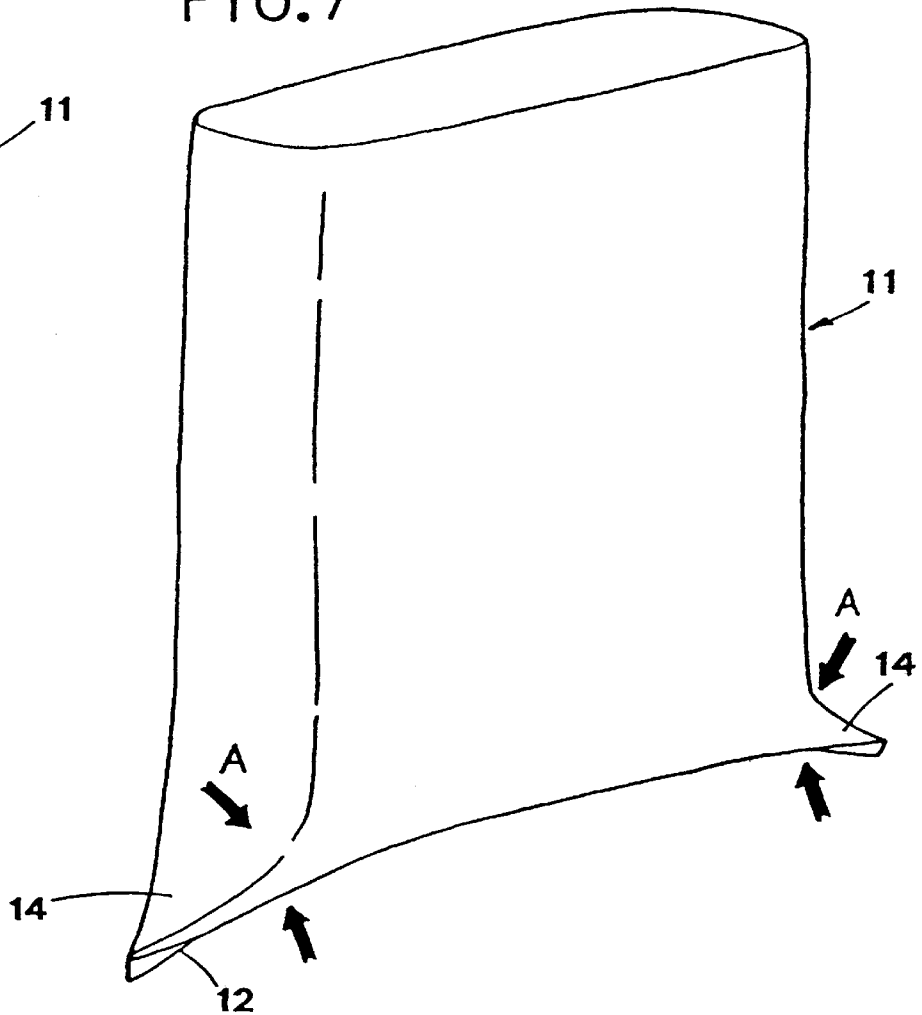

The opposite extremities of the bottom of the bag are pressed down by means of appropriate gripping tools as shown by arrows A in FIG. 7 so as to define the respective angular sections 14 across which seam 12 partially extends along the central line.

Figure 8:
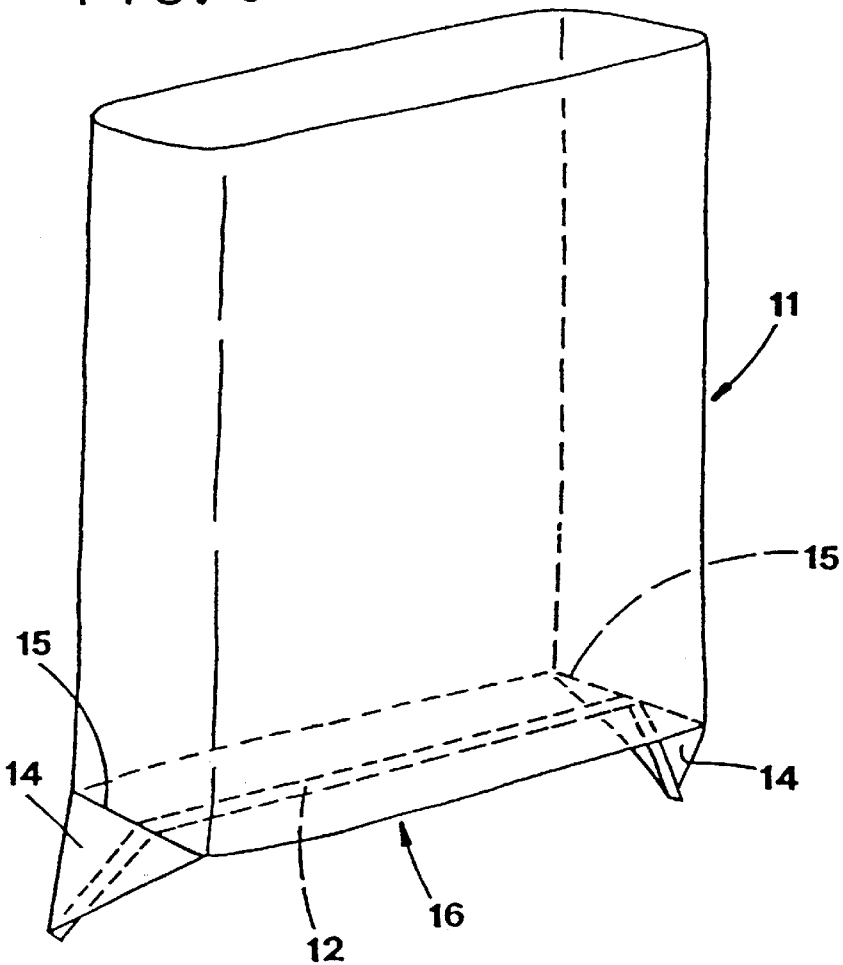

The angular sections 14 are next sealed along seam lines 15 laid crosswise with respect to the bottom seam 12 and then folded in correspondence to said seams 15 towards the bottom of the bag (FIG. 8). Seams 15 define the width of the bottom of the bag comprising an essentially rectangular surface 16.

Figure 9:
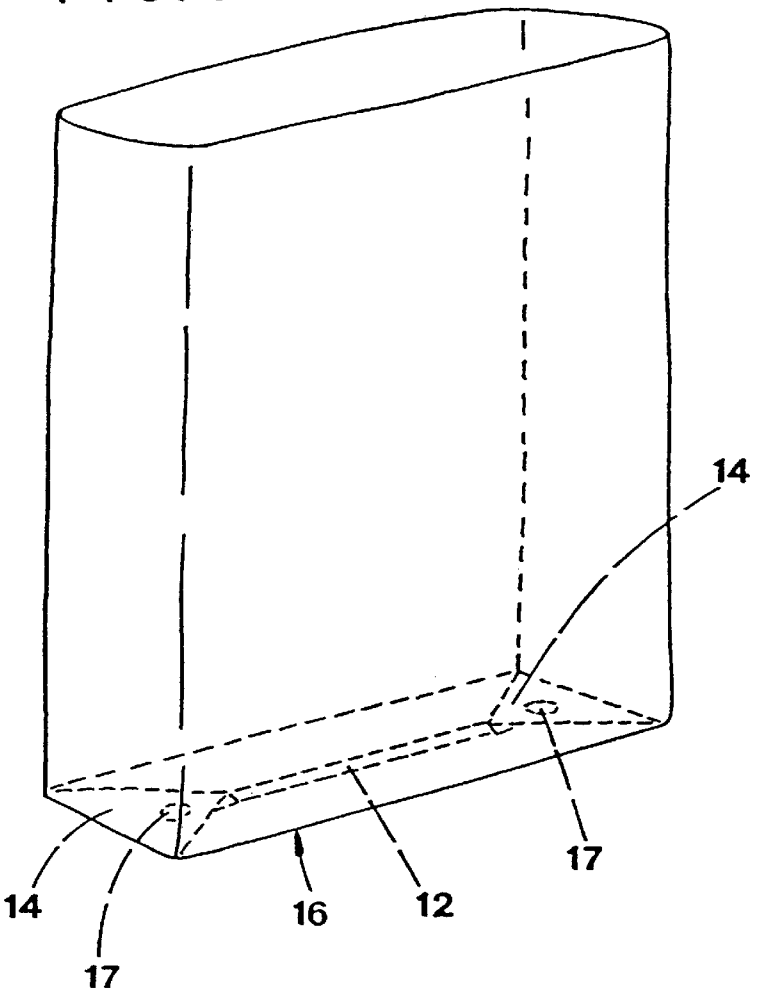

Angular sections 14 are secured to the bottom 16 of the bag by means of spots 17 of a suitable glue (FIG. 9).

Figure 10:
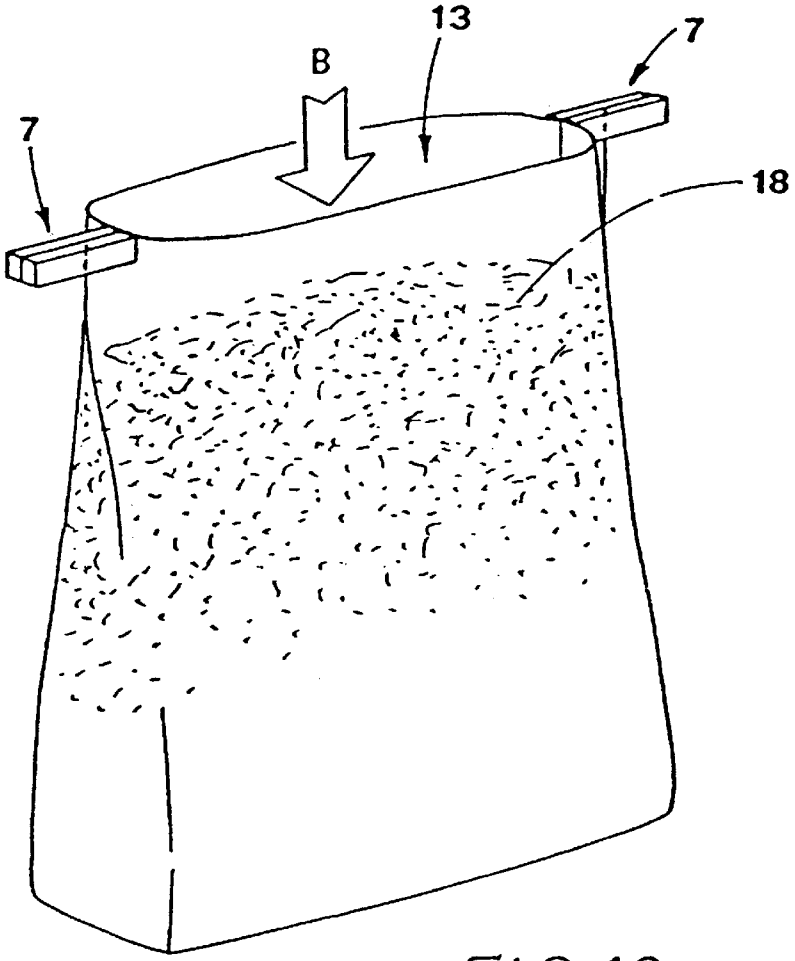

The bag is subsequently filled with products 18, which are introduced through opening 13 as indicated by arrow B in FIG. 10.

Figure 11:
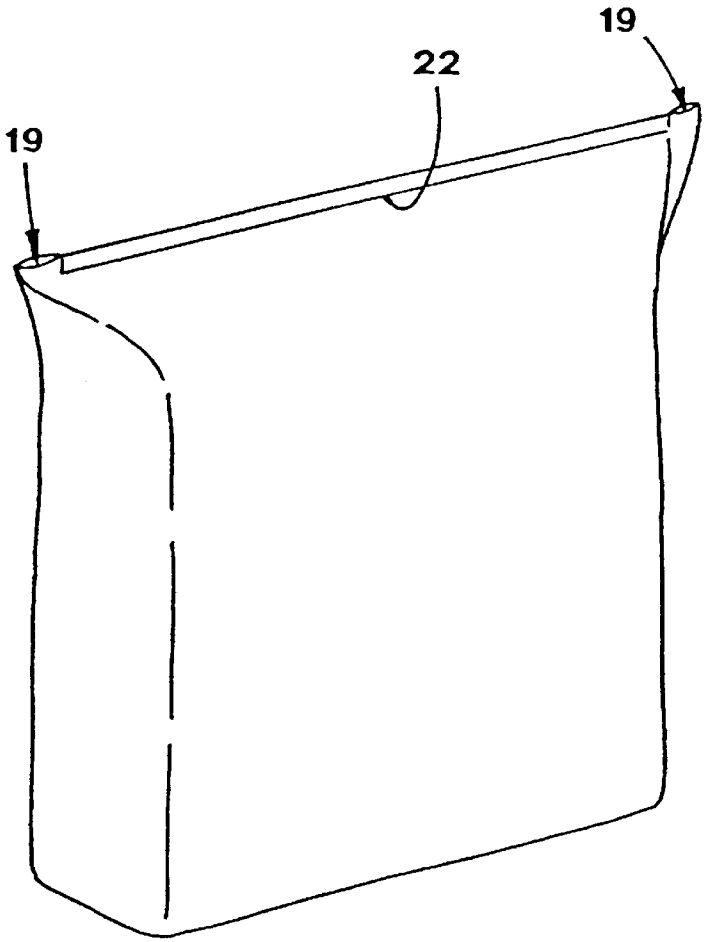

Opening 13 is then closed at least partially by means of a second crosswise seam 22 (FIG. 11). Seam 22 extends crosswise to the head of the tubular element in such a way as to allow vents 19 at the opposite ends.

Figure 12:
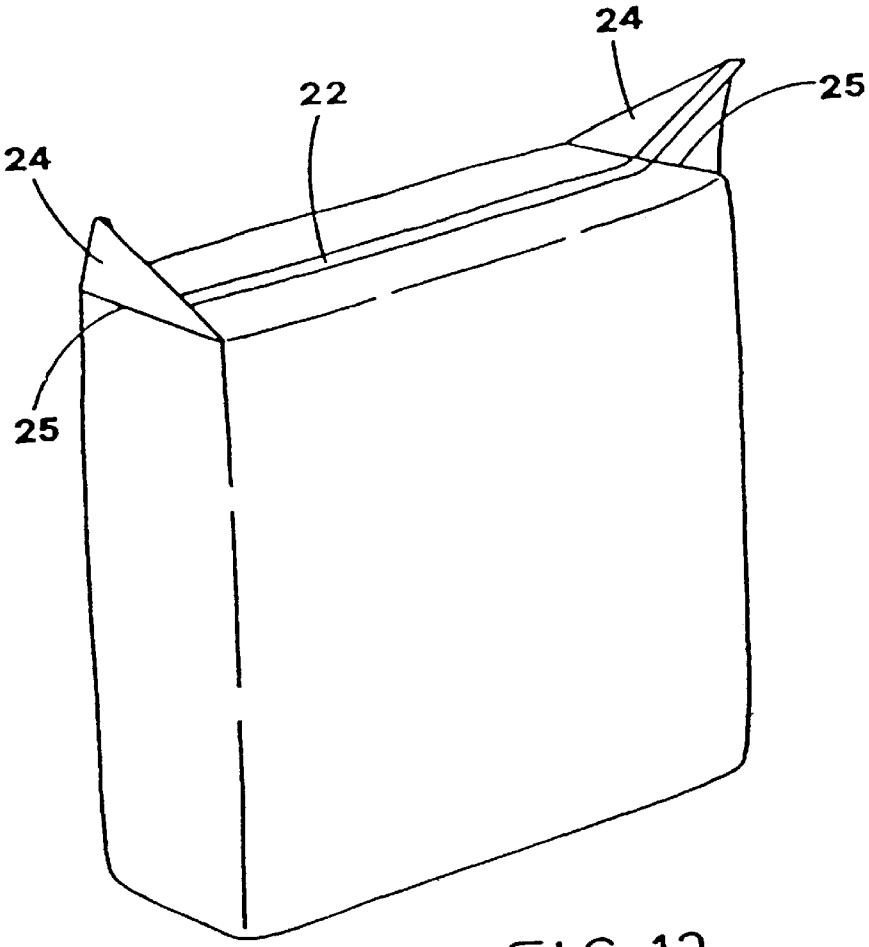

The bag is then completely closed by defining the angular sections 24 at the extremities of the top in a manner similar to that described for the bottom of the bag (FIG. 12). The angular sections 24, sealed by means of seams 25 crosswise to seam 22, are then folded towards the top of the bag and secured by glue spots. Seams 25 close off vents 19.

The shape of top 26 defined by seams 25 is rectangular and essentially similar to that of bottom 16.

Bag 20 made according to the method described is formed from a non-gusseted tubular element of plastic material. It follows that at the top and bottom of the bag two facing sheets are sealed together along the entire width of the tubular element, as clearly shown in FIGS. 5 and 11, unlike in the traditional methods employing gusseted tubular material. This permits to form the bag under optimal sealing conditions, thus avoiding discontinuities in the seam and, consequently, the formation of weak points.

The bag thus formed is therefore highly resistant, especially along the two seams 12 and 22. The angular sections 14 and 24 sealed along seam 15 and 25 and folded back over the external surface of the bag also contribute to improving the overall strength of the bag.

In the present embodiment of this invention angular sections 14 and 24 are folded back over the bottom 16 and top 26 of the bag, respectively. These angular sections 14 and 24 may however be folded back against the sides 21 of the bag.

In addition to the advantages so far described, non-gusseted tubular material also makes for a lower basic cost and for smaller rolls. In fact, the folded gusseted edges of gusseted tubular material entail a double thickness which, in turn, means that the diameter of the roll is much greater.

A further advantage of using non-gusseted tubular elements is the possibility of submitting the entire external surface of the material to pretreatment for printing without any detriment to subsequent sealing. In fact, unlike with the traditional gusseted tubular material where the flaps of the gusseted external surfaces facing each other also come to be sealed, only the internal surfaces of the non-gusseted tubular element undergo sealing.

Identification data and any other possible information can therefore be printed on the entire surface of the bag, including the sides.

An important feature of the method herein described is the high productivity rate it permits thanks to the high filling rate. In fact, as the opening of the bag is not hampered by any constrictions, filling is easier and quicker.

Although in the present description the angular sections 14 and 24 are defined by sealing seams 15 and 25, it will be appreciated that said junction lines may alternatively be made by means of appropriate glues or other means.

It is obvious that the above description is intended to be purely illustrative and does not limit in any way the scope of the invention. Accordingly, any and all modifications and variations thereto should be considered to fall within the scope of the invention as described and claimed herein.

What is claimed is:

1. A method of producing bags from plastic material, comprising the steps of:

cutting individual bags from a roll of tubular plastic material by forming cut lines extending transversely across the tubular material at spaced intervals defining a bag length;

forming a bottom seam line across the open lower end of each bag length simultaneously with formation of each cut line;

setting up each bag so as to form a bag having an inner surface and an external surface, the bag having a sealed lower end having opposite corners and an open upper end providing a filling opening, the filling opening having opposite ends each aligned with a respective corner at the sealed lower end of the bag;

pressing the opposite corners at the lower end of the bag downwardly so as to define angular sections across which the lower end seal extends along a central line of each angular section;

sealing the angular sections off from the remainder of the bag by forming auxiliary seams extending transversely across the lower end seal;

folding each angular section back about the respective auxiliary seam until the angular section lies against the external surface of the bag;

filling the bag with a predetermined quantity of a product;

forming a top seam across the open upper end of the bag to at least partially close the filling opening;

defining angular sections at opposite ends of the filling opening;

sealing off each angular section at the upper end of the bag with auxiliary seams extending transversely relative to said top seam; and folding each angular section at the upper end of the bag back about the respective auxiliary seam so that the angular sections lie against the external surface of the bag.

2. The method as claimed in claim 1, including the steps of securing each angular section at the upper and lower end of the bag against the external surface of the bag with adhesive.

3. The method as claimed in claim 1, wherein the angular sections at the lower end of the bag are folded back against the lower end of the bag, and the angular sections at the upper end of the bag are folded back against the upper end of the bag.

4. The method as claimed in claim 1, wherein the top seam extends partially across the filling opening to form vents at opposite ends of the filling opening, the vents subsequently being sealed off by formation of the auxiliary seams extending transverse to the top seam.

5. The method as claimed in claim 1, wherein each cut line has a first side forming the open upper end of a bag and a second side forming the lower end of a subsequent bag to be cut, and the bottom seam is formed along said second side simultaneously with the cutting so as to form a closed lower end of the next bag to be cut.

6. The method as claimed in claim 1, wherein the auxiliary seams are formed by sealing.

7. The method as claimed in claim 1, wherein the auxiliary seams are sealed with adhesive.

8. A bag, comprising:

a tubular, bag-forming element of plastic material having a lower end seam and an upper end seam extending across the tubular element, opposite sides, an external surface, and an internal surface;

each seam having opposite end portions;

the tubular element having a transverse, auxiliary seam extending across each of the end portions of each end seam to form an angular section at each side of the bag at the lower end and upper end of the bag; and each angular section being folded back against the external surface of the bag-forming element.

9. The bag as claimed in claim 8, wherein the auxiliary seams comprise seal lines.

10. The bag as claimed in claim 8, wherein opposing portions of the internal surface are secured together by adhesive along said auxiliary seams.

11. The bag as claimed in claim 8, wherein each angular section is secured to the external surface of the bag-forming element by adhesive.

* * * * *

UNITED STATES PATENT AND TRADEMARK OFFICE

CERTIFICATE OF CORRECTION

PATENT NO. : 6,226,964 B1
DATED : May 8, 2001
INVENTOR(S) : Vettorato, Natale

It is certified that error appears in the above-identified patent and that said Letters Patent is hereby corrected as shown below:

Column 2,
Line 28, delete "SUMMARY OF THE INVENTION".
Line 22, insert -- SUMMARY OF THE INVENTION --.

Column 4,
Line 20, delete "What is claimed:"

Signed and Sealed this

Twenty-fourth Day of September, 2002

*Attest:*

*Attesting Officer*

JAMES E. ROGAN
*Director of the United States Patent and Trademark Office*